US006212683B1

(12) United States Patent
Liebmann

(10) Patent No.: US 6,212,683 B1
(45) Date of Patent: Apr. 10, 2001

(54) DISPOSABLE ADHESIVE PROTECTIVE GARMENT ON STRIP AND METHOD OF MAKING SAME

(76) Inventor: Bonnie J. Liebmann, 239 Walnut Ave., Santa Cruz, CA (US) 95060

( * ) Notice: Subject to any disclaimer, the term of this patent is extended or adjusted under 35 U.S.C. 154(b) by 0 days.

(21) Appl. No.: 09/338,911

(22) Filed: Jun. 23, 1999

(51) Int. Cl.[7] ..... A41B 13/10
(52) U.S. Cl. ..... 2/49.4; 2/48; 2/52
(58) Field of Search ..... 2/49.1, 49.2, 49.3, 2/49.4, 49.5, 50, 51, 52, 48, 46

(56) References Cited

U.S. PATENT DOCUMENTS

| | | | | |
|---|---|---|---|---|
| D. 303,175 | | 9/1989 | Wilson et al. | D2/227 |
| 3,221,341 | * | 12/1965 | Hummel | 2/48 |
| 3,299,440 | * | 1/1967 | Grable | 2/49.1 |
| 4,288,877 | * | 9/1981 | Klepfer | 2/48 |
| 4,306,316 | | 12/1981 | Klepfer | 2/48 |
| 4,330,888 | * | 5/1982 | Klepfer | 2/48 |
| 4,423,523 | | 1/1984 | Bodner et al. | 2/49 R |
| 4,622,698 | | 11/1986 | Heyman et al. | 2/49 R |
| 5,491,844 | | 2/1996 | Kehl et al. | 2/49.1 |
| 5,644,793 | * | 7/1997 | Lahaussois | 2/49.1 |
| 5,661,851 | | 9/1997 | Sanchez | 2/49.4 |
| 5,881,382 | * | 3/1999 | Bernard et al. | 2/49.4 |
| 5,930,837 | * | 8/1999 | Anvar | 2/52 |
| 6,079,048 | * | 6/2000 | Campbell | 2/52 |

FOREIGN PATENT DOCUMENTS

| | | | | |
|---|---|---|---|---|
| 2616046 | * | 12/1988 | (FR) | 2/49.4 |

* cited by examiner

*Primary Examiner*—Amy B. Vanatta
(74) *Attorney, Agent, or Firm*—Thomas Schneck

(57) ABSTRACT

Disposable protective garments are formed in a side-to-side orientation having a top adhesive strip extending side to side from the top of the garment and a second adhesive strip on the bottom of the garment. The garments are produced by a manufacturing process in which a roll of absorbent material is unwound, printed upon, laminated, dried and rewound, and then processed to apply the adhesive strips and dice and perforate the sheet of material to separate the sheet into individual strips of disposable protective garments separated in a side-to-side orientation by perforations.

7 Claims, 6 Drawing Sheets

DISPOSABLE ADHESIVE PROTECTIVE GARMENT ON STRIP AND METHOD OF MAKING SAME

FIELD OF THE INVENTION

This invention relates to disposable protective garments and more particularly relates to disposable protective garments detachable from a strip of such garments.

BACKGROUND OF THE INVENTION

Disposable protective garments are often employed to protect clothing from being soiled by spills. For example, dentists or medical professionals often attach a disposable piece of material to the front of a patient to protect the patient's clothing from spills. A disposable, self-adhesive garment is especially advantageous in that it can be readily disposed of without requiring any reused attachment means to be sterilized. Seafood restaurants often provide for patrons a protective bib to protect clothing from being stained by splattering liquid from crabs or lobsters. In addition such protective garments are often used on children to catch spilled food.

Various disposable garments have been described. U.S. Pat. No. 4,622,698 to Heyman et al. describes a disposable bib. The bibs are dispensed as part of a continuous strand. On the strand, each bib is attached end to end, with each and having a concave upper margin and a convex lower margin. These margins are separated forming two straps with an area of material extending between these straps. The straps are tied around the neck of the user while the body of the bib extends over the user's front. The ends of the strap are coated with adhesive to allow the ends of the strap to be joined. The disposable bibs are manufactured in an end-to-end fashion on a continuous strand.

In a similar fashion, U.S. Pat. No. 5,661,851 to Sanchez describes a disposable bib which may be dispensed from a strand in an end-to-end fashion. The bib is composed of a central portion of water absorbent material sandwiched between a water repellent backing and a framing front piece. The backing has a strap which is affixed about the user's neck by a small adhesive section.

These two bibs present certain disadvantages. Devices secured around children's necks are disfavored because they present certain safety hazards resulting from restriction of breathing and possible choking. Additionally, adhesive can catch in the hair of the person wearing the bib if the bib is attached by an adhesive behind the wearer. If the person wearing the bib leans forward, the bib will swing away from the person's body. The bib may then contact food or possibly get caught on an object.

To avoid the possible dangers of neck straps some protective garments have instead been affixed to the user's front by an adhesive. U.S. Design Pat. No. D303,175 discloses a strip of end-to-end connected bibs with adhesive tabs near the top of the bib to attach the bib to the wearer's front. U.S. Pat. No. 4,306,316 to Klepfer describes another protective garment. The garment is formed by applying a pressure sensitive adhesive coating to a top edge along the length of a piece of material, slicing the material into individual use sections and then folding each section in half. When the garment is unfolded it may then be affixed to the front of the user. U.S. Pat. No. 4,423,523 to Bodner et al. describes a strip of overlapping bibs. The bibs are joined end to end along the strip. An adhesive strip disposed across the width of the bib allows attachment of each bib to a user. None of these references teaches a garment that is prevented from swinging away from a wearer's body.

In manufacturing the protective garments in an end-to-end fashion the adhesive must be applied in a direction perpendicular to the length of the material from which the protective garments are fashioned. This presents certain manufacturing difficulties. Improved methods of manufacturing would provide a simpler, more efficient manufacturing process while maximizing output by simplifying production.

It is an object of the invention to disclose an improved method of manufacturing disposable protective garments.

It is a further object of the invention to produce a roll of side-to-side joined disposable protective garments. Such a garment should have a liquid resistant backing and a liquid absorbent front. This garment should be attached to the user by an adhesive strip disposed along the top of the garment and should have an additional adhesive section on the bottom of the disposable garment to prevent the garment moving away from the user's front.

SUMMARY OF THE INVENTION

The above objects have been achieved through a new process for production of disposable protective garments. In this process a sheet of absorbent material is unwound from a roll and laminated on one side with a laminate resistant to liquid flowthrough. The laminate is dried and a continuous strip of adhesive is affixed to the laminated side of the sheet. The sheet is then dye cut into a desired shape by a dye cutting roller. This roller also perforates the sheet at regular lengths, the resulting perforation allowing tear-away separation of the garments from a strip. The continuous strip is then rewound into a continuous roll and severed from the primary roll. These rolls can then be individually placed into a dispensing container or packaged for shipping. Prior to dye cutting it is possible to include a step of printing on the front side of the disposable protective garments using various printing methods. The front of the garment could then include printing.

A further aspect of the invention is the produced roll of disposable protective garments. The roll is comprised of a length of absorbent material having a backing of liquid resistant material. Along the top edge of the roll is a band of adhesive to allow each garment to be secured to the user's front. An adhesive strip is applied to the bottom of the garment. The garments are dye cut into a pattern. This pattern allows each disposable protective garment to conform to the user's neckline. The roll is perforated at regular intervals allowing each disposable protective garment to be removed from the roll and be worn by a user. The resulting protective garments are attached to each other in a side to side orientation on the roll.

DETAILED DESCRIPTION

The disposable protective garment of the applicant's invention allows simplified manufacture by side to side orientation of the protective garments along a dispensing strip. The garments produced are then secured to the front of the user by a top adhesive strip and a bottom adhesive section.

Figure 1:
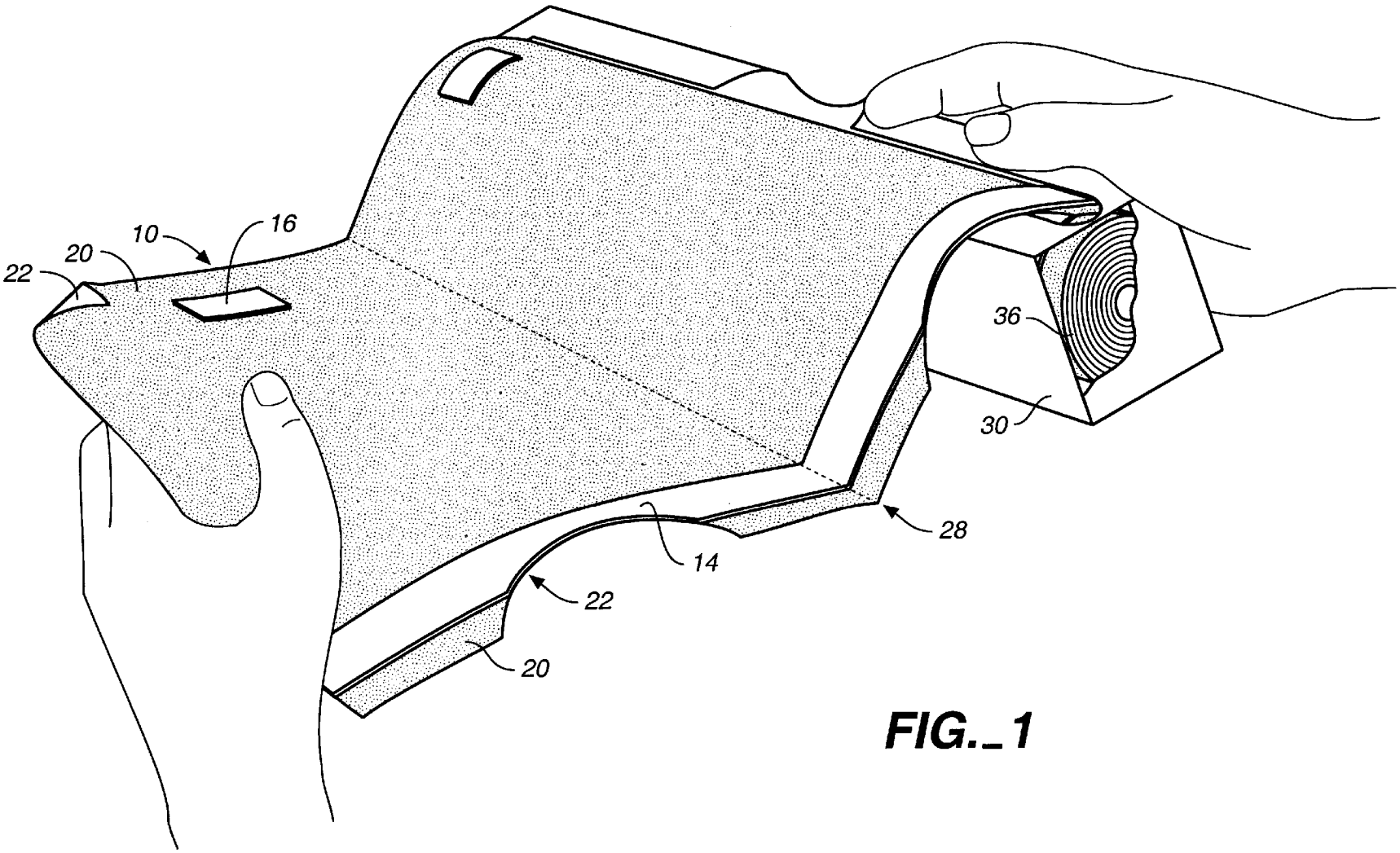
FIG. 1 illustrates a perspective view of a roll of disposable protective garments in accordance with the invention.

In reference to FIG. 1, a user is shown removing a disposable protective garment 10 from dispensing box 30. The strips of disposable protective garments are contained within dispensing box 30 on roll 36. The back side of disposable garment 10 has a liquid impermeable laminate 20 covering the entire back side of the disposable protective garment 10. The disposable garments may be separated from one another by tearing along perforation line 28. This allows the user to tear off each individual disposable protective garment for individual use. On the reverse side of the disposable protective garment 10 is liquid absorbent material 22.

Attached onto liquid impermeable laminate 20 are adhesive strips 14, 16. Adhesive strip 14 is positioned at the top of the garment and runs along the side to side length of the garment. Adhesive bottom strip 16 is shown as a shorter length of adhesive positioned near the bottom at the center of the side to side width of the garment.

Figure 2:
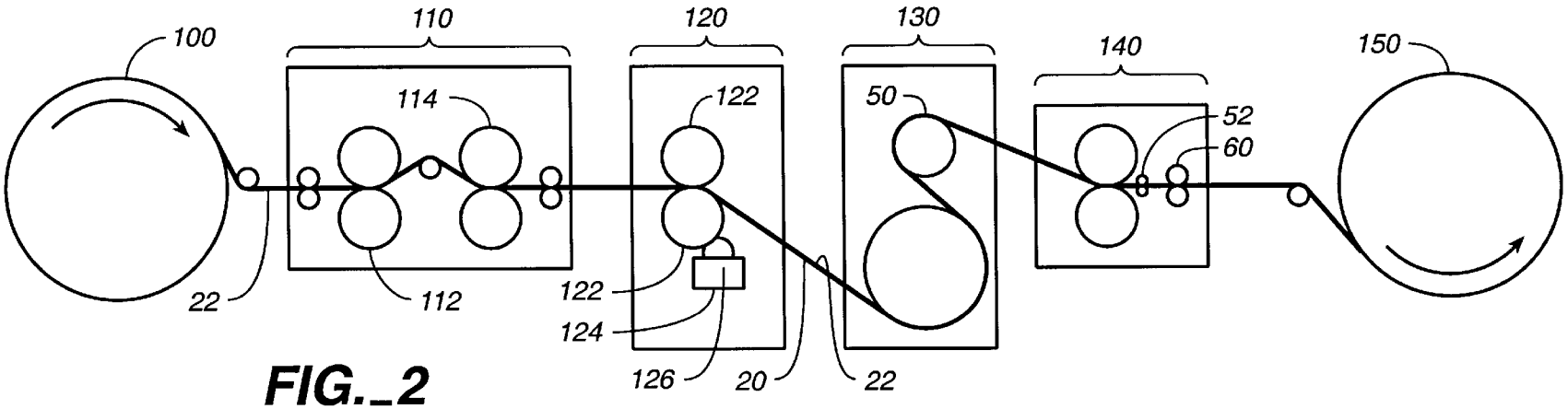
FIG. 2 illustrates a schematic of the manufacturing process used to produce garments seen in FIG. 1.

FIG. 2 shows a schematic of the manufacturing process for producing disposable protective garments shown in FIG. 1. The process begins by unrolling a continuous sheet of liquid absorbent material 22 from master roll 100. The continuous sheet of liquid absorbent material may be comprised of porous paper, non-woven cotton, or various multiple layered absorbent materials.

As the continuous sheet is unrolled it is directed by rollers into printing system 110. In printing system 110 the sheet of liquid absorbent material is rolled between first set of printing drums 112 and second set of printing drums 114. These drums contact the sheet of liquid absorbent material 22 and are able to transfer printing to the sheet of absorbent material by thermal transfer printing, applied on-line ink transfer, or other known printing methods. It is also possible that an electrostatic printhead could be used in place of pairs of printing drums 112, 114. The printer applies decorative indicia in repetitive patterns onto one side of the sheet of liquid absorbent material. Although the printing system is illustrated as occurring before the lamination, it is also possible to print after lamination has occurred.

The material after passing through printing system 110 is transferred into lamination system 120. In lamination system 120 the sheet is rolled between lamination drums 122. As sheet of liquid absorbent material 22 is rolled between lamination drums 122, an even coating of laminate is applied to one side of the sheet. This can be effected by unrolling laminate roll 126 onto lamination drum 122. As laminate roll 126 unrolls, it is in contact with adhesive reservoir 124 such that the unrolling roll of laminate is coated with an adhesive. As the adhesive coated laminate comes in contact with sheet of liquid absorbent material 22, the two sheets bond together such that one sheet is formed having a liquid absorbent material layer 22 and a liquid impermeable laminate layer 20. Although it is possible to use as a laminate material various plastic, rubberized or polymeric materials it is preferred to use a polyethylene film web that is 0.5 millimeter thick. The preferred adhesives used to bond the sheet of absorbent material 22 to the liquid impermeable layer 20 are water based.

The laminated sheet then moves from lamination system 120 into drying tunnel 130. In drying tunnel 130 heat is applied such that the water-based adhesive dries bonding the two layers 20, 22 of the sheet together. The sheet is then rewound onto roll 50.

The laminated sheet then passes from drying tunnel 130 into processing system 140. Processing system 140 is further illustrated in FIGS. 3 and 3A. Finally the roll is rewound onto product roll 150. Product roll 150 allows the system to maintain a dynamic tension such that the sheet is firmly held against the drums of the production system. Product roll 150 can then be further processed into individual rolls which are packaged either individually in shrink-wrap or in dispensing boxes.

Figure 3:
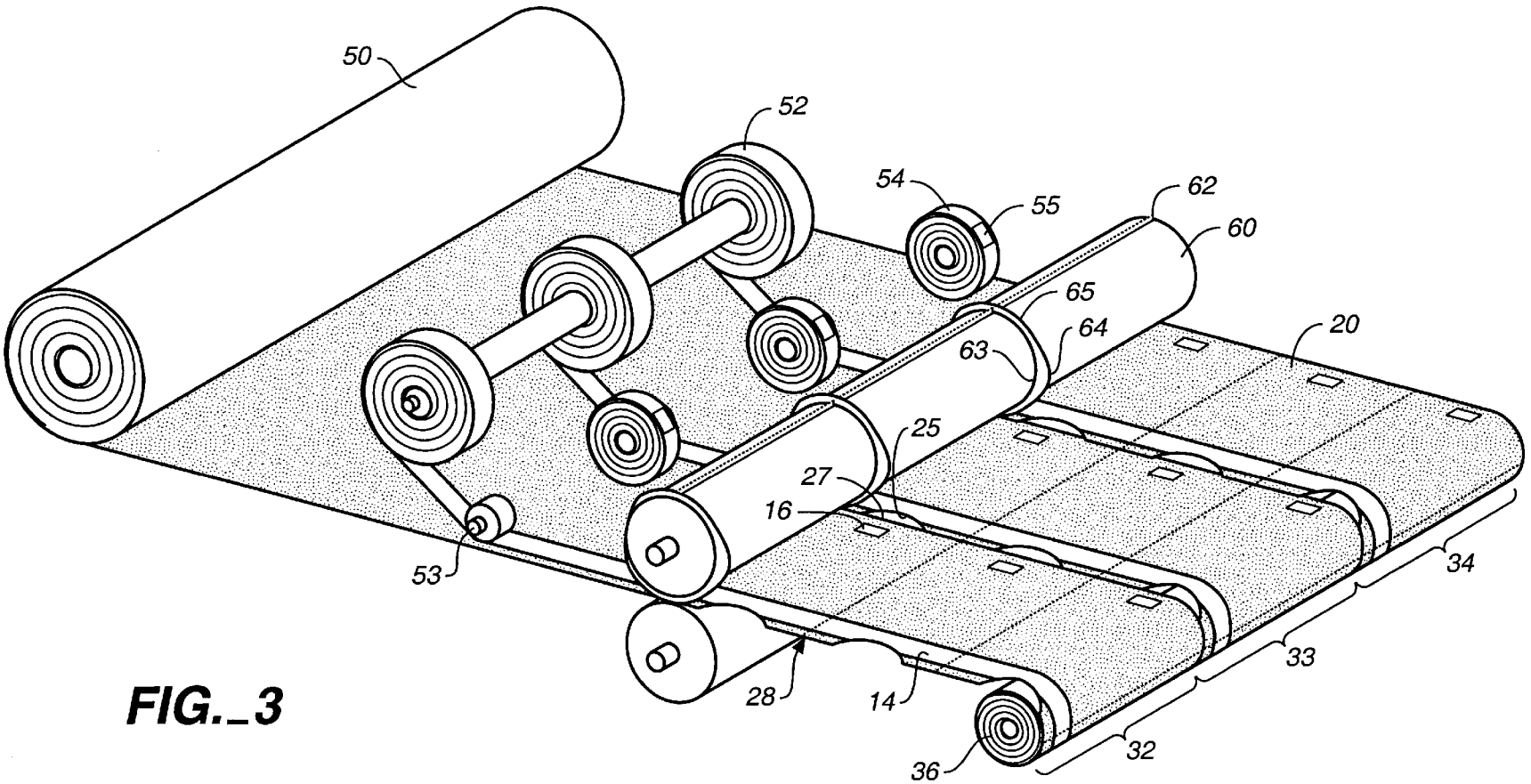
FIG. 3 provides a detail of the manufacturing process shown in FIG. 2.

The processing system 140 of FIG. 2 is further illustrated in FIG. 3. In this system the laminate absorbent material is unrolled from roll 50. This processing system performs the final steps in making the disposable garment. These steps include application of the adhesive strips onto the laminated sheet, as well as dicing and perforating the laminated sheet into individual strips of garments.

In the processing system, rolls of adhesive tape 52 are unrolled and adhesive strip 14 is applied by pressure roller 53 onto the liquid impermeable laminate sheet 20. The rolls of adhesive tape 52 unroll onto the length of sheet 20. Each of the rolls of adhesive tape 52 is spaced apart at discrete distances along the width of the sheet 20. This separation distance is the top to bottom length of one strip of protective garments. In a similar manner, rolls of adhesive tape 54 are also positioned in a parallel orientation separated by a distance such that they dispense adhesive onto liquid impermeable laminate 20. Roll of adhesive tape 54 has a tape cut out 55 such that adhesive strip 16 is not continuously dispensed onto the liquid impermeable laminate 20 but instead is dispensed at regular intervals on liquid impermeable laminate 20. Alternatively a continuous strand of adhesive tape may be dispensed by roll of adhesive tape 54 such that the tape extends along the length of laminate sheet 20. The positioning of roll of adhesive tape 52 and roll of adhesive tape 54 is such that the rolls of tape are separated by a length equal to the desired length of the garment. When the roll is subsequently cut, the tapes are positioned such that one length of adhesive extends across the top of each garment that is formed and the other adhesive strip is positioned on the bottom of the garment formed with both of the adhesives applied to the laminated back side of the garment.

A number of adhesives are adaptable to the present invention. The preferred adhesive is a roll of double-sided tape with plastic release liner. One side of the tape adheres to liquid impermeable laminate 20. The other side of the double-sided adhesive tape is covered by a plastic release liner. This liner may be subsequently removed exposing the sticky surface of the adhesive tape. The adhesive tape is selected such that it is adhesive to clothing without staining the clothing. Alternative adhesives, such as removable pressure sensitive adhesives may also be used. This type of adhesive would be applied in the desired strip by a roller in contact with the adhesive reservoir. Several sticky, removable pressure-sensitive adhesives are known.

After the adhesive is applied, the sheet is next passed such that it presses against dye cut roller 60. Dye cut roller 60 has at regular intervals, dye cut blade 65. Dye cut blade 65 has an arc blade 64 and a straight edge blade 63. The blades are positioned perpendicularly to the axis of rotation. Dye cut roller 60 also has a perforating blade 62 positioned parallel to the axis of rotation. As dye cut roller rolls, it contacts the moving sheet of laminated material. Arc blade 64 cuts this sheet such that arcs are formed in the sheet at regular intervals. Blade straight edge 63 cuts the material such that the material sheet is divided into discrete widths each width being the width of a single strip of disposable protective garments. Perforating blade 62 then makes a perforating cut 28 at regular intervals along the sheet. The dye cut blades result in the production of protective garments with a top scoop cut 25 and a bottom straight line cut 27. A small arc of material is removed from the sheet in this production process. Bottom straight line cut 27 separates the sheet of material into individual rolls of protective garments 32, 33, 34.

Figure 3B:
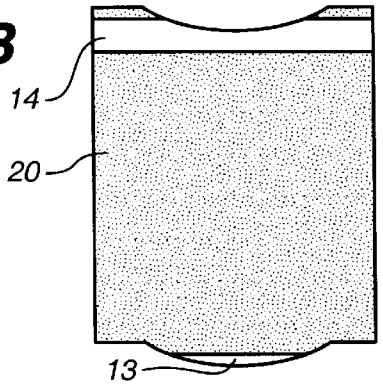
FIG. 3B shows the back side of a disposable protective garment made by the manufacturing process illustrated in FIG. 3A.
Figure 3A:
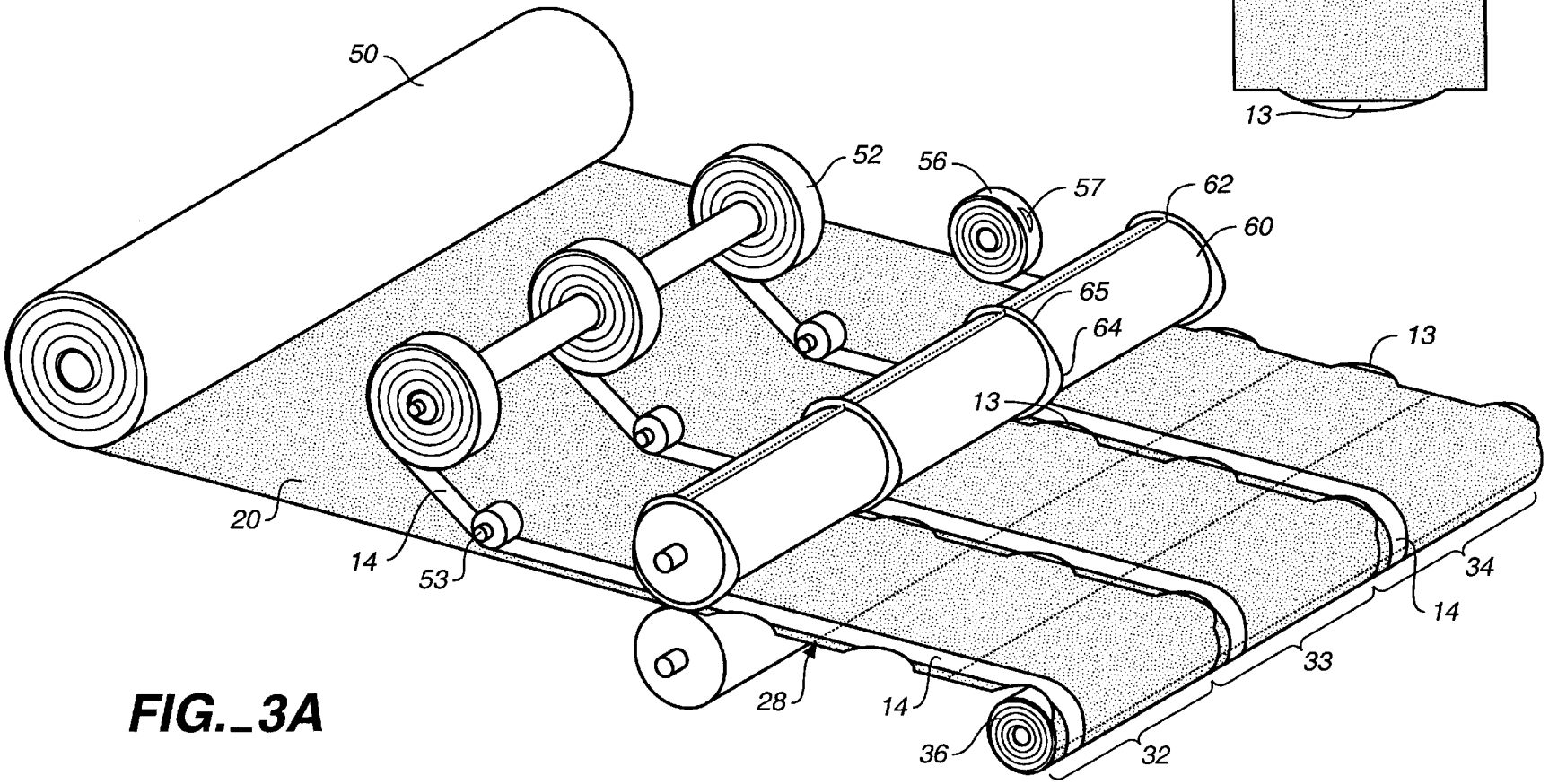
FIG. 3A shows an alternative process to the detail shown in FIG. 3.

An alternative processing system is shown in FIG. 3A. Again roll 50 unrolls the base sheet of material. Adhesive tape rolls 52 again unroll tape 14 at regular intervals. Tape 14 adheres to liquid impermeable laminate 20 when it is pressed onto this material by roller 53. At the far edge of the sheet, edge roll of adhesive tape 56 has a tape arc cut out 57 which applies an arc of tape to the edge of the sheet.

Dye cut roller 60 has at regular intervals dye cut blade 65. Dye cut blade 65 has an arc blade 64 that at regular patterns cuts a scoop arc through the material along the length of the material as the material is drawn past the rotating blade. Because the blade is positioned on a cylinder, the cylinder may be rotated such that the blade cuts a pattern at a regular interval into the material. Dye cut blade 65 and roll of adhesive tape 52 are positioned such that the arc cut by dye cut blade 65 cuts through adhesive tape 14. This leaves a small arc of adhesive tape 13 cut away from strip of adhesive tape 14. The cut made by dye cut blade 65 also separates one disposable protective garment from another along the width of the sheet of laminated material. This again results in individual rolls of disposable protective garments 32, 33 and 34.

FIG. 3B shows an individual disposable protective garment made by the process shown in FIG. 3A. The liquid impermeable laminate 20 is shown having running across the top an adhesive top strip 14. An arc has been cut from adhesive top strip 14. On the bottom of the garment is arc of adhesive tape 13. FIG. 3A illustrates how using one roll of adhesive tape and a single dye cut both top and bottom adhesive strip can be added to the disposable protective garment further simplifying the production of the disposable protective garments. The blade which cuts through the strip of adhesive tape also separates the sheet of laminated material into individual strips of disposable protective garments 32, 33, 34.

Figure 4:
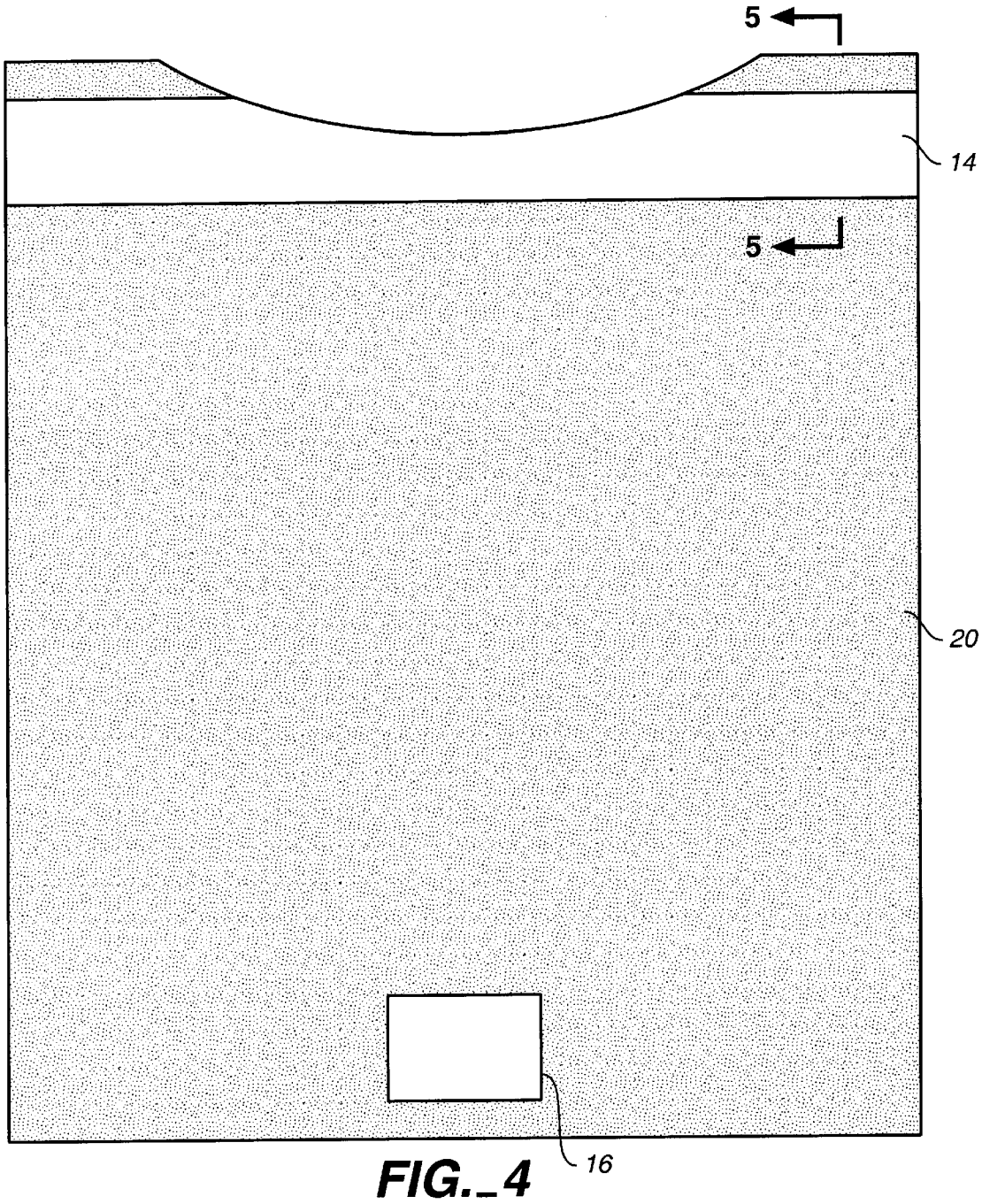
FIG. 4 shows the back side of the protective garment torn from the roll shown in FIG. 1.

FIG. 4 illustrates the back side of disposable protective garment. Liquid impermeable laminate 20 covers the entirety of the back side. Extending across the top of the disposable protective garment from side to side is adhesive strip 14. Centrally located on the bottom of the back side of the disposable protective garment is adhesive bottom strip 16. Arrows 4 indicate a cross-sectional cut illustrated in FIG. 5.

Figure 5:
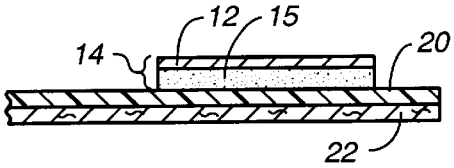
FIG. 5 shows a cross-section of a portion of the disposable protective garment of FIG. 1 including a cross-sectional view of the adhesive strip with release liner.

FIG. 5 illustrates the cross-sectional cut of a section of the disposable protective garment including a cross section of the top adhesive strip 14. As shown liquid absorbent material 22 has been laminated onto liquid impermeable laminate 20. On top of liquid impermeable laminate 20 is adhesive top strip 14. Adhesive top strip 14 is composed of a plastic release liner 12 and a length of two-sided adhesive tape 15 positioned between plastic release liner 12 and liquid impermeable laminate 20. Plastic release liner 12 may be peeled away exposing an adhesive layer of two-sided adhesive tape 15. Because each side of two-sided adhesive tape 15 has adhesive properties, one side may adhere to liquid impermeable laminate 20 while the other side may adhere to the wearer of the disposable protective garment.

Figure 6:
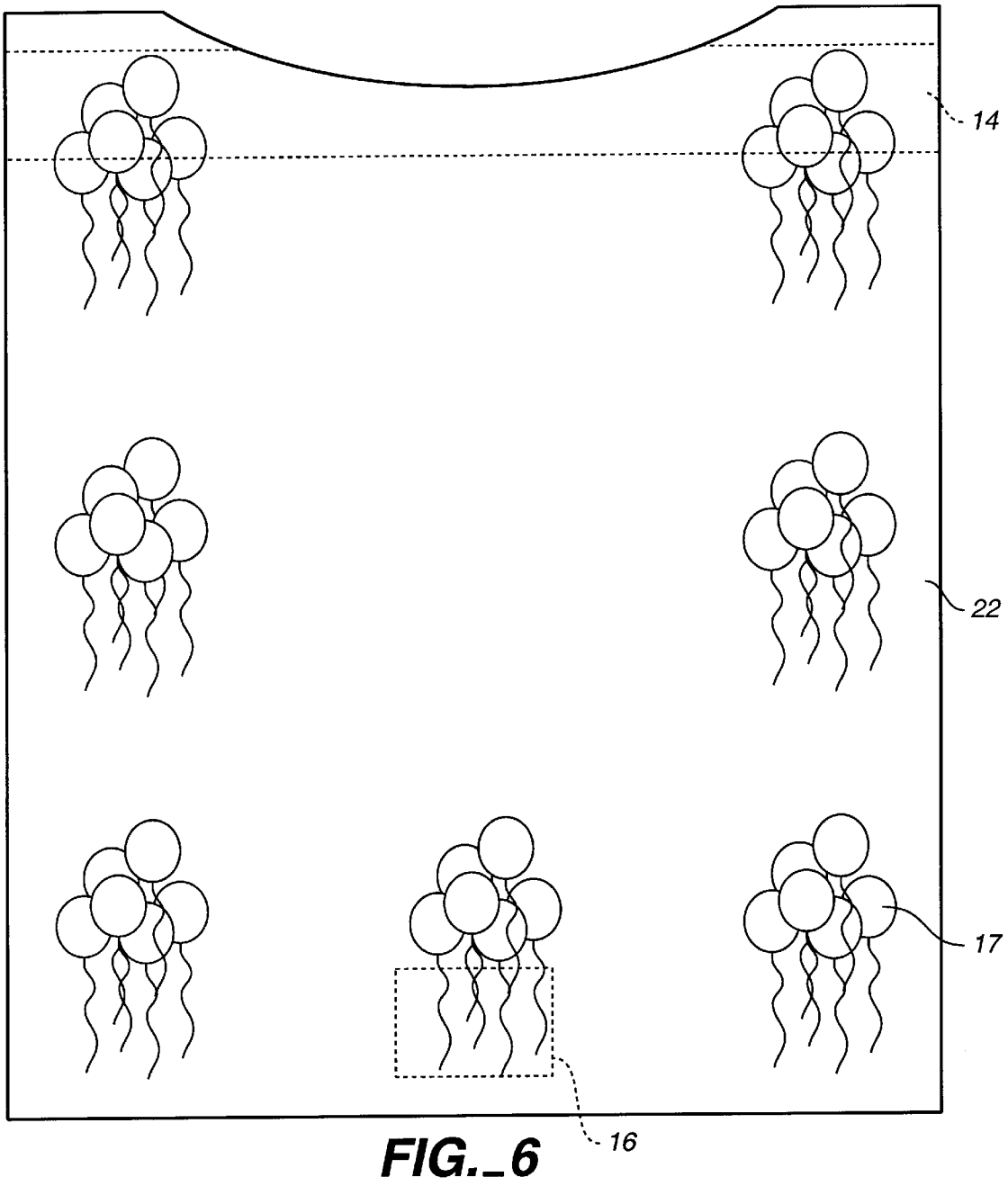
FIG. 6 shows a front view of the protective garment of FIG. 4.

The reverse side of the disposable protective garment shown in FIG. 4 is seen in FIG. 6. This front side is comprised of liquid absorbent material 22. Printed onto liquid absorbent material 22 is printing 17. This side of the garment would be visible when the garment is secured to the user by adhesive strip 14, 16.

I claim:

1. A roll of disposable protective garments comprising, a continuous length of absorbent material having a width;

a continuous length of liquid resistant material bonded to one side of said absorbent material;

a first adhesive strip applied along the entire length of the resistant material proximate to a first edge of said length of liquid resistant material;

a second adhesive strip applied along a portion of the length of the resistant material proximate to a second edge opposite said first edge;

a pattern of arcs at regular intervals along one side of said length; and a perforated pattern extending across the width of material at regular intervals along said length.

2. The roll of disposable protective garments of claim 1 wherein said absorbent material has decorative indicia in repetitive patterns along the length thereof.

3. The roll of disposable protective garments of claim 1, wherein at least one of said adhesive strips is double sided tape with a release liner.

4. The roll of disposable protective garments of claim 1, wherein at least one of said adhesive strips is a strip of pressure sensitive adhesive.

5. The roll of disposable protective garments of claim 1 wherein said length of liquid resistant material is a polyethylene film bonded to said absorbent material using a water based adhesive.

6. The roll of disposable protective garments of claim 1 wherein said length of absorbent material is comprised of non-woven cotton.

7. The roll of disposable protective garments of claim 1 wherein said length of absorbent material is comprised of porous paper.

* * * * *